United States Patent [19]

Kronich

[11] Patent Number: 5,046,458

[45] **Date of Patent: * Sep. 10, 1991**

[54] AIR-COOLED ENGINE FLYWHEEL FAN ROTATIONAL DEBRIS INLET SCREEN

[75] Inventor: Peter G. Kronich, Sheboygan, Wis.

[73] Assignee: Tecumseh Products Company, Tecumseh, Mich.

[21] Appl. No.: 580,636

[22] Filed: Sep. 11, 1990

[51] Int. Cl.[5] ..... F01P 7/04

[52] U.S. Cl. ..... 123/41.63; 123/41.7; 55/400; 55/437

[58] Field of Search ..... 123/41.63, 41.65, 41.7, 123/41.66; 55/290, 385.3, 400, 407, 437, 502, 525

[56] References Cited

U.S. PATENT DOCUMENTS

| | | | |
|---|---|---|---|
| 958,612 | 5/1910 | Eyermann | 415/106 |
| 1,639,684 | 8/1927 | Bott | 384/55 |
| 2,014,859 | 3/1934 | Mitchell | 308/187 |
| 2,108,724 | 2/1938 | Nemetz | 286/5 |
| 2,766,022 | 10/1956 | Bender | 259/122 |
| 3,183,899 | 5/1965 | Tuggle | 123/41.65 |
| 3,252,449 | 5/1966 | Couchman, Jr. et al. | 123/41.65 |
| 4,332,310 | 6/1982 | Iwai et al. | 188/218 |
| 4,589,379 | 5/1986 | Fujikawa et al. | 123/41.49 |
| 4,838,908 | 6/1989 | Bader et al. | 123/41.66 |

*Primary Examiner*—Noah P. Kamen

*Attorney, Agent, or Firm*—Jeffers, Hoffman & Niewyk

[57] ABSTRACT

An air-cooled internal combustion engine having a rotating screen and a blower housing surrounding the screen. A ring is attached to the housing and positioned circumjacent the screen to define a precisely gauged radial clearance gap between the ring and the rotating screen. The ring provides a tortuous entry path for foreign matter entering through the air intake port between the ring and the screen. The ring includes a downwardly extending groove into which extends an upwardly turned lip of the rotating screen to form the tortuous path for foreign matter entering through the clearance gap between the inner periphery of the ring and the outer periphery of the main portion of the screen. Large debris and foreign matter entering through the tortuous path is chopped up into small pieces, which may then pass through the cooling fins.

17 Claims, 2 Drawing Sheets

AIR-COOLED ENGINE FLYWHEEL FAN ROTATIONAL DEBRIS INLET SCREEN

BACKGROUND OF THE INVENTION

The present invention relates generally to air-cooled internal combustion engines of the type utilizing rotational inlet screens to prevent the entry of foreign matter into the air intake ports. More particularly, the invention relates to such an engine wherein a tortuous entry path is formed for foreign matter entering the gap between the rotating inlet screen and the blower housing.

In an air-cooled combustion engine, air is the cooling substance. The barrier between the air and the hot gases in the engine is the engine cylinder and crankcase. These parts must present the greatest possible surface to the air if cooling is to be effective. An effective means of directing a stream of moving air over the surfaces must also be provided in the engine design.

These conditions are met in the cylinder blocks by providing cooling fins around the circumference, thereby presenting a greatly increased surface area to the air. Ventilation is necessary so that fresh air can constantly be blown across the engine to provide maximum cooling. Therefore, a fan or blower, which is incorporated in the flywheel, is utilized to direct a cooling stream of air across the cylinder block and other engine parts.

In normal operation, air-cooled engines are often exposed to air containing a large quantity of foreign matter, such as dirt, grass clippings, or matted debris. These materials enter the engine through the air intake port and collect on the surfaces of the engine and between the cylinder fins. The buildup of this foreign matter decreases the available surface area of the engine to the cooling air stream as well as insulates the hot metal from the air stream, often resulting in premature engine wear. Thus it is very important that all cooling surfaces be kept free from debris.

In order to reduce the amount of foreign matter that reaches the interior of the engine, screens are typically placed over the air intake port. These screens are either fixed or rotational. Generally more effective protection against the build up of foreign matter is provided by rotational screens since they are designed to rotate along with the engine cooling fan and fling foreign matter away from the screen as it nears the air intake port.

Although the use of rotating screens is generally effective in preventing the build up and entry of foreign matter through most of the air intake port, problems still exist with respect to foreign matter entering the engine through the gap defined by the peripheral edge of the rotational screen and the inlet edge of the air intake port of the blower housing.

In the past, the radial clearance between the rotational fan inlet screen and the blower housing has ranged from about ⅛ inch to 3/16 inch due to production tolerances of the components and the total tolerance stack up of the assembled components. Since precise gauging of the blower housing inlet and the rotational screen has not been practical, these relatively large clearance gaps between the inlet and the screen have allowed long grass blades, chaff, small leaves, and other foreign matter to enter the blower housing and be retained within the cooling fins of the cylinder and cylinder head, thus causing a build up of "bird nest" clusters, which restrict the flow of cooling air over the engine cooling fins and insulate the fins to prevent heat transfer from the engine.

In order to reduce the amount of foreign matter entering the interior of the engine through this clearance gap, it has been attempted to provide a tortuous path through which foreign matter must travel before entering the interior of the engine. Although such a path between the annular flange of the blower housing and the interacting peripheral skirt of the screen provides a longer path that foreign matter must travel before reaching the interior of the engine, there still exists the problem of buildup of foreign matter within the tortuous path. In addition, there still exists the problem of a relatively large clearance gap between the outer periphery of the rotational screen and the annular flange of the blower housing.

SUMMARY OF THE INVENTION

The present invention overcomes the problems of the prior art by providing an air cooled internal combustion engine having a rotating screen and a blower housing surrounding the screen, wherein a ring is attached to the housing and positioned circumjacent the screen to define a precisely gauged radial clearance gap between the ring and the rotating screen. In addition, the ring provides a tortuous entry path for foreign matter entering through the air intake between the ring and the screen.

More particularly, the present invention provides a ring having a downwardly extending groove into which extends an upwardly turned lip of the rotating screen to form tortuous entry path for any foreign matter entering through the clearance gap between the inner periphery of the ring and the outer periphery of the main portion of the screen. Large debris and foreign matter entering through this tortuous path is chopped up into small pieces, which then pass through the cooling fins.

One advantage of the engine of the present invention is that a tortuous path is formed between the rotating screen and blower housing to increase the distance foreign matter must travel before reaching the interior of the engine shroud.

Another advantage of the engine according to the present invention is that any large pieces of foreign matter such as grass which migrate past the radial clearance gap are sheared and reduced to clippings which are small enough in size to pass through the engine cooling fins on both the head and the cylinder block.

A further advantage of the engine of the present invention is that a smaller and more precisely gauged radial gap may be achieved between the housing and the rotating screen so that a minimal amount of foreign matter enters the radial clearance gap between the rotating screen and the housing without a buildup of the foreign matter in the gap itself.

A further advantage of the engine of the present invention is that the radial clearance ring is shaped to blend with the blower housing so that there are no sharp edges or turns.

Still another advantage of the engine of the present invention is that debris within the tortuous path is chopped up into smaller pieces which pass through the engine.

The invention, in one form thereof, provides an air-cooled internal combustion engine including a rotatable crankshaft and a flywheel attached to one end of the crankshaft for rotation therewith. A screen is connected to and rotatable with the flywheel. The screen has a generally annular main portion and an upwardly turned lip radially outward from the outer periphery of the main portion. A housing surrounds the screen and has an air intake opening generally coaxial with the flywheel. A ring is attached to the housing and positioned circumjacent the main portion of the screen. The ring has a downwardly extending groove into which extends the upwardly turned lip thereby forming a tortuous entry path for any foreign matter entering through the air intake between the outer periphery of the main portion of the screen and the inner periphery of the ring.

The present invention, in one form thereof, comprises an air-cooled internal combustion engine having a rotatable crankshaft and a flywheel attached to one end of the crankshaft for rotation therewith. The engine includes an air inlet screen assembly for blocking the entry of foreign matter into the engine. The screen assembly includes a screen connected to and rotatable with the flywheel. The screen has a generally annular main portion and an upwardly turned lip radially outward from the outer periphery of the main portion. A housing surrounds the screen and has an air intake opening generally coaxial with the flywheel. The housing includes a downwardly extending inner peripheral flange portion extending radially between the main portion and the upwardly turned lift to define a radial clearance space between the outer periphery of the main body portion and the inner peripheral flanged portion. The flanged portion and upwardly turned lip form a tortuous entry path for foreign matter entering through the clearance space.

DESCRIPTION OF THE PREFERRED EMBODIMENT

Figure 1:
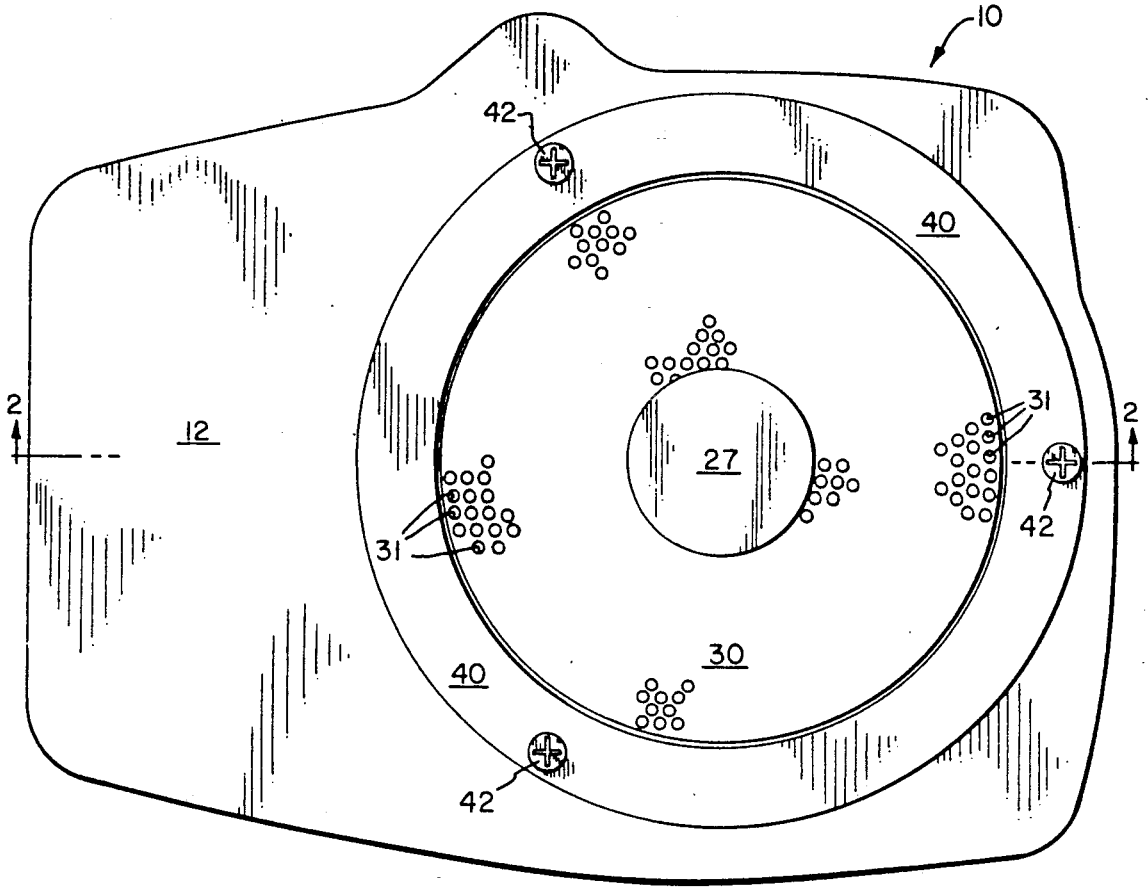
FIG. 1 is a top plan view of an air-cooled internal combustion engine particularly showing the clearance control ring in accordance with the present invention.
Figure 2:
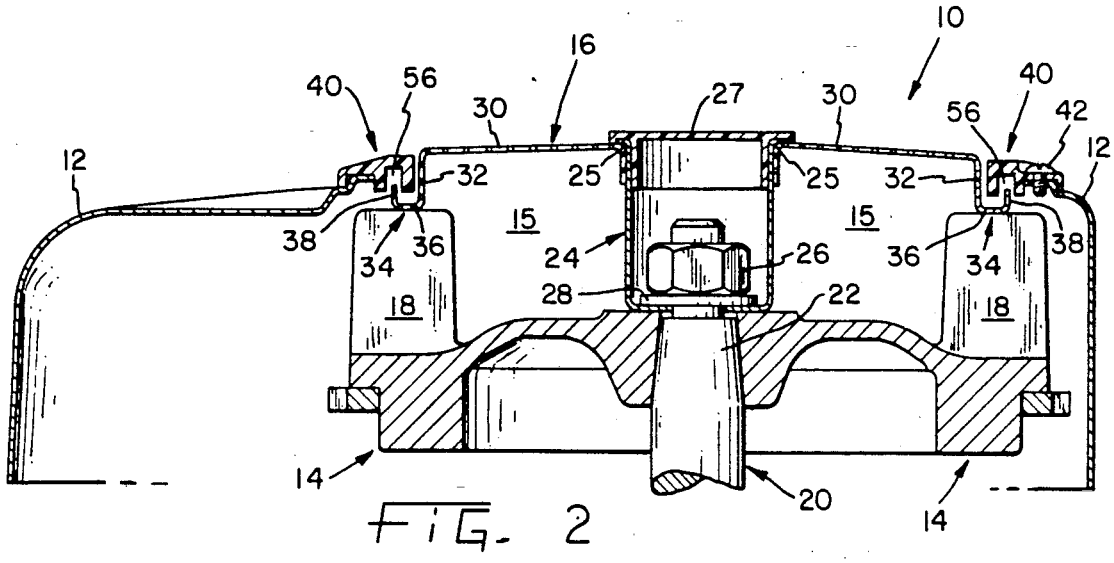
FIG. 2 is a fragmentary sectional view of the engine of FIG. 1; taken along line 2—2 in FIG. 1.

In an exemplary embodiment of the invention as shown in the drawings, and in particular by referring to FIGS. 1 and 2, an air-cooled internal combustion engine 10 is shown having a blower housing generally designated at 12. Housing 12 encloses a flywheel 14 having blower vanes 18 which function as a cooling fan to draw air downwardly through a screened inlet opening 15 and produce cooling air for the engine parts. Although FIG. 2 illustrates an engine in which flywheel 14 includes blower vanes 18 that are cast into flywheel 14, a separate blower wheel (not shown) may be alternatively used. Flywheel 14 is frictionally secured to tapered end 22 of crankshaft 20 and may be keyed against rotation relative to crankshaft 20 by means of a locking key (not shown). A threaded retention nut 26 and washer 28 hold flywheel 14 on crankshaft 20. A screen 16 is mounted on a drawn cup 24 which is fastened to the end of crankshaft 20 by nut 26 and washer 28; therefore, screen 16 rotates with crankshaft 20. Screen 16 may be either integrally formed with cup 24 or secured to its outer peripheral edge at lip 25. An appropriate cap member 27 is frictionally secured over cup 24 to cover nut 26.

Screen 16 has a plurality of circular holes or perforations 31 to allow air to pass through screen 16 and into the engine. Screen 16 is generally annular in shape and includes a circular main body portion 30, a downwardly extending outer peripheral portion 32 and a lip portion 34. Lip portion 34 includes an outwardly extending flanged portion 36 and an upwardly extending portion 38 which is spaced radially outward of downwardly extending peripheral portion 32. As best shown in FIG. 2, outwardly extending flange portion 36 rests on vanes 18 of flywheel fan 14 s that lip portion 34 is supported by flywheel 14 upon rotation.

Figure 3:
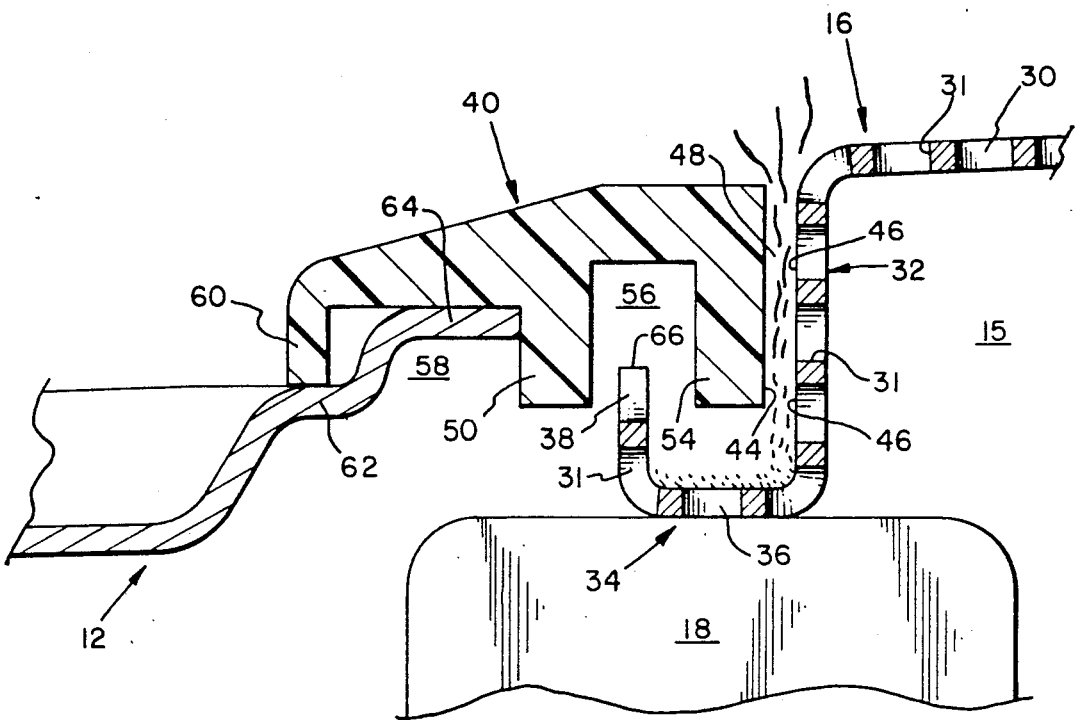
FIG. 3 is an enlarged sectional view of the tortuous entry path between the clearance ring and the rotating screen.

A clearance control ring 40, preferably made of a plastic material such as high density polyethylene or reinforced nylon, is fastened to blower housing 12 by screws 42 as illustrated in FIGS. 1 and 2. Although preferably made of plastic, ring 40 may also be made from die cast aluminum. Ring 40 is generally contoured relative to housing 12 such that there are no sharp edges or bends As best shown in FIG. 3, ring 40 is located circumjacent screen 16 such that the downwardly extending inner periphery of ring 40, designated at 44, and outer periphery 46 of downwardly extending peripheral portion 32 form a radial clearance gap 48 therebetween. Preferably, clearance gap 48 ranges from 0.030 inches to 0.060 inches; however, gaps larger than 0.060 inches may also be used. It is noted that a radial clearance gap less than 0.030 inches tends to impact fine grass and other foreign material against outer periphery 46 of screen 16 which clogs radial gap 48. In addition, the foreign material tends to accumulate on flywheel 14 upon engine shutdown. With a radial clearance gap of at least 0.030 inches, such a situation does not occur, and vertical surface 46 is self-cleaning.

The underside of plastic radial clearance control ring 40 includes downwardly extending portions 50 and 54 to form a downwardly extending groove 56. A second downwardly extending groove 58 is formed by downwardly extending portion 50 and downwardly extending outer peripheral portion 60. Housing 12 extends upwardly in step-like fashion such that the bottom surface of downwardly extending peripheral portion 60 abuts the top surface of inwardly extending flange portion 62 so that ring 40 tends to "blend" into the step-like contour of blower housing 12. The innermost circular flange 64 of housing 12 fits into groove 58 so that screw 42 secures ring 40 to flange 64.

Figure 4:
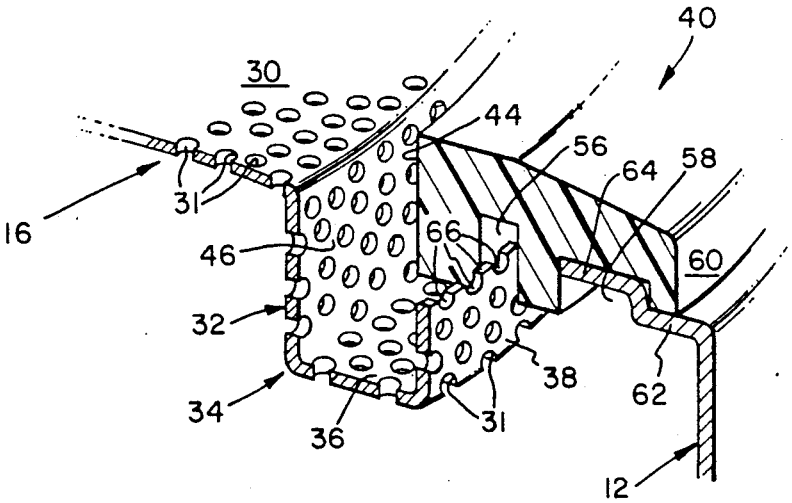
FIG. 4 is an enlarged fragmentary perspective view of the radial clearance control ring and the rotating screen.

Referring again to FIG. 3, a tortuous entry path is formed between lip 34 of screen 16 and the inner portion of ring 40. In particular, foreign matter must travel vertically through gap 48 and then horizontally between downwardly extending portion 54 and outwardly extending flange portion 36. As illustrated in FIG. 3, foreign matter entering through clearance gap 48 is generally cut up into small pieces when it reaches outwardly extending flange portion 36. Foreign matter is also cut up further into the tortuous path as described below. Any foreign matter falling through perforations 31 on outwardly extending flange portion 36 is small enough to fall through the cylinder fins and out the engine. The larger foreign matter must then travel upwardly between upwardly extending portion 38 and downwardly extending portion 54. At this point in the tortuous path, any foreign matter, such as grass, that is not cut up in clearance gap 48 is chopped up by the jagged top edge 66 of upwardly extending portion 38, which is rotating. As shown in FIG. 4, jagged edge 66 is formed by the intersection of the top edge of upwardly extending portion 38 with a row of perforations 31. Once cut by jagged edge 66, the foreign matter is small enough to pass through the cylinder fins when it reaches the part of the tortuous path between upwardly extending portion 38 and downwardly extending portion 50. Thus, the arrangement of the present invention lengthens the path foreign matter must travel to reach the engine interior as well as provides a screen which chops up any foreign matter within the tortuous path.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An air-cooled internal combustion engine, comprising:

a rotatable crankshaft;

a flywheel- attached to one end of said crankshaft for rotation therewith, said flywheel having blower means connected thereto for blowing air over said engine;

a screen connected to and rotatable with said flywheel, said screen having a generally annular main portion and upwardly turned lip radially outwardly from the outer periphery of said main portion;

a housing surrounding said screen and having an air intake opening generally coaxial with said flywheel; and a ring attached to said housing and positioned circumjacent said main portion of said screen, said ring having a downwardly extending groove into which extends said upwardly turned lip, whereby a tortuous entry path is formed for any foreign matter entering through the air intake between the outer periphery of said main portion of said screen and the inner periphery of said ring.

2. The engine of claim 1, wherein said upwardly turned lip shears the foreign matter in said tortuous entry path upon rotation of said crankshaft.

3. The engine of claim 1, wherein said screen is perforated.

4. The engine of claim 3, wherein the top surface of said upwardly turned lip intersects with at least one perforation to form a jagged edge.

5. The engine of claim 1, wherein said groove comprises a first downwardly extending groove and said ring further includes a second downwardly extending groove radially outward of said first groove, wherein a generally upwardly extending flanged portion of said housing is securably attached to said ring within said second groove.

6. The engine of claim 1, wherein the outer of said main portion of said screen is spaced from the inner periphery of said ring a distance from about 0.030 inches to about 0.060 inches.

7. The engine of claim 1, wherein the top surface of said upwardly turned lip comprises a jagged edge.

8. The engine of claim 1, wherein the top surface of said ring comprises a generally flat inner circular portion, a sloped portion sloping downwardly in the direction away from said flat portion, and a downwardly extending outer peripheral portion.

9. The engine of claim 1, wherein said ring is made of a plastic material.

10. In an air-cooled internal combustion engine comprising a rotatable crankshaft and a flywheel attached to one end of the crankshaft for rotation therewith, said flywheel having blower means connected thereto for blowing air over said engine, an air inlet screen assembly for blocking the entry of foreign matter into the engine, the assembly comprising:

a screen connected to and rotatable with the flywheel, said screen having a generally annular main portion and an upwardly turned lip radially outwardly from the outer periphery of said main portion; and a housing surrounding said screen and having an air intake opening generally coaxial with said flywheel, said housing including a downwardly extending inner peripheral flanged portion extending radially between said main portion and said upwardly turned lip to define a radial clearance space between the outer periphery of said main body portion and said inner peripheral flanged portion, whereby a tortuous entry path is formed for the foreign matter entering through said clearance space.

11. The assembly of claim 10, wherein said upwardly turned lip shears the foreign matter in said tortuous entry path upon rotation of the crankshaft.

12. The assembly of claim 10, wherein said screen is perforated.

13. The assembly of claim 12, wherein the top surface of said upwardly turned lip intersects with at least one perforation to form a jagged edge.

14. The assembly of claim 10, wherein said radial clearance space is between about 0.030 inches and about 0.060 inches.

15. The assembly of claim 10, wherein the top surface of said upwardly turned lip comprises a jagged edge.

16. An air-cooled internal combustion engine, comprising: a rotatable crankshaft;

a flywheel attached to one end of said crankshaft for rotation therewith, said flywheel having blower means connected thereto for blowing air over said engine;

a perforated screen connected to and rotatable with said flywheel, said screen having a generally annular main portion and an upwardly turned lip radially outwardly from the outer periphery of said main portion, wherein the top surface of said upwardly turned lip comprises a jagged edge;

a housing surrounding said screen and having an air intake opening generally coaxial with said flywheel; and a ring attached to said housing and positioned circumjacent said main portion of said screen, said ring having a downwardly extending groove into which extends said upwardly turned lip, whereby a tortuous entry path is formed for any foreign matter entering through the air intake between the outer periphery of said main portion of said screen and the inner periphery of said ring;

said upwardly turned lip shearing the foreign matter in said tortuous entry path upon rotation of said crankshaft.

17. The engine of claim 16, wherein the outer periphery of said main portion of said screen is spaced from the inner periphery of said ring a distance ranging from about 0.030 inches to about 0.060 inches.

* * * * *

UNITED STATES PATENT AND TRADEMARK OFFICE

CERTIFICATE OF CORRECTION

PATENT NO. : 5,046,458

DATED : September 10, 1991

INVENTOR(S) : Peter G. Kronich

It is certified that error appears in the above-identified patent and that said Letters Patent is hereby corrected as shown below:

On the abstract page, delete "*" before the date of patent.

Signed and Sealed this

Twelfth Day of January, 1993

*Attest:*

DOUGLAS B. COMER

*Attesting Officer*

*Acting Commissioner of Patents and Trademarks*